United States Patent [19]

Runge

[11] 4,390,928

[45] Jun. 28, 1983

[54] CONTAINER

[75] Inventor: Hermann Runge, Regensburg-Mintraching, Fed. Rep. of Germany

[73] Assignee: Boerung-Gebrauchsartikel GmbH, Regensburg, Fed. Rep. of Germany

[21] Appl. No.: 288,781

[22] Filed: Jul. 31, 1981

[30] Foreign Application Priority Data

Mar. 20, 1981 [DE] Fed. Rep. of Germany ..... 3111102

[51] Int. Cl.[3] ..... F21V 33/00

[52] U.S. Cl. ..... 362/101; 362/190; 362/205; 362/208; 362/802; 362/806

[58] Field of Search ..... 362/101, 190, 205, 208, 362/802, 806

[56] References Cited

U.S. PATENT DOCUMENTS

| | | | |
|---|---|---|---|
| 2,663,866 | 12/1953 | Simpson | 362/101 |
| 3,218,447 | 11/1965 | Pardue | 362/101 |
| 3,374,344 | 3/1968 | Rudolph et al. | 362/101 |
| 3,735,113 | 5/1973 | Stott | 362/101 |
| 3,878,386 | 4/1975 | Douglas | 362/101 |

*Primary Examiner*—Stephen J. Lechert, Jr.
*Attorney, Agent, or Firm*—Armstrong, Nikaido, Marmelstein & Kubovcik

[57] ABSTRACT

The invention relates to a container, in particular a drinks container, which comprises two spatially separated container chambers, wherein the separating surface means which joins the two container chambers together is of a transparent nature, a reflector is arranged behind the separating surface means and a lamp is inserted into the reflector, and wherein the lamp is connected by way of a switch to a current source which is disposed in one of the container chambers. When the container is tilted, a contact is made, which connects the lamp to the current source and causes the lamp to light.

19 Claims, 9 Drawing Figures

CONTAINER

Figure 1:
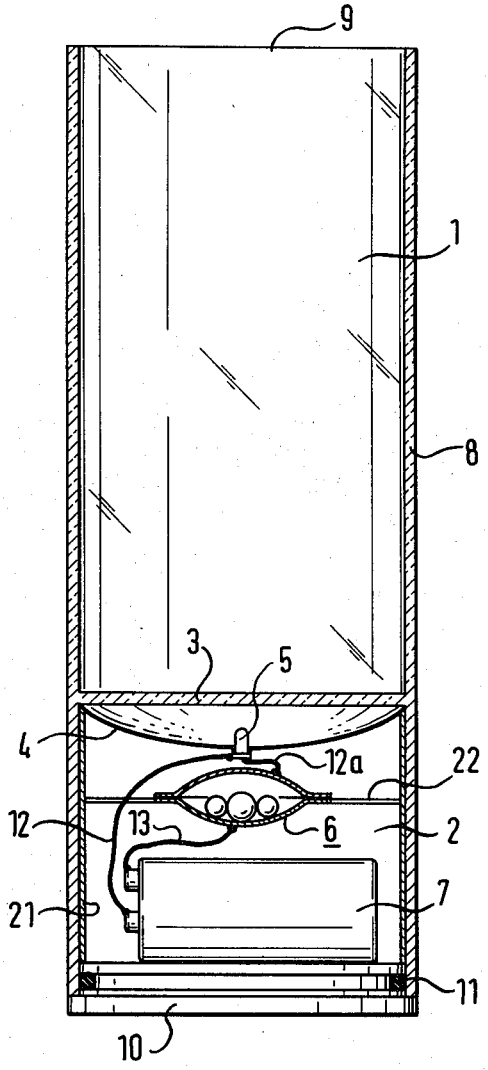

The invention relates to a container, in particular a liquids container, which comprises at least two spatially separated container chambers.

Widely varying drinks containers or vessels are known. There was now a requirement for a liquids container which produces a light signal when it is tipped or tilted and which is unlit in the unused position. The container should also be such that it can be washed out.

This problem is solved by a container of the kind set forth hereinbefore, characterised in that the two container chambers are separated from each other by a transparent separating surface means, or are connected to each other by way of said surface means, arranged below or behind the separating surface means is a reflector with a lamp which is passed through the reflector, and the lamp is connected to a current source by way of a switch.

The container or vessel according to the invention has the advantage that it looks like a normal vessel, in the position in which it is not being used, and is lit only when the vessel is moved into a sufficiently inclined position. The container according to the invention is not restricted in regard to the location in which it can be used, with a battery power source, and it can be freely moved and it can also be washed out. The container according to the invention is distinguished by a very simple design principle which can be used for widely different purposes.

The two chambers of the container according to the invention are preferably arranged one above the other and are separated from each other by a transparent separating surface means or wall portion in such a way as to form an upper chamber and a lower chamber. It is also possible however for the two chambers to be arranged one beside the other.

It may also be advantageous for two or more containers to be arranged one beside the other and for the illumination system to be disposed in a separate chamber of at least one of the containers.

The transparent separating surface means between the two chambers of the container may be integrally connected to the wall of the container. It is also possible however for the separating surface means or dividing wall portion to be fitted into the container, in which case however care should be taken to ensure that the separating surface means is water-tightly sealed in place if the container is to be used for drinks. The separating surface means may preferably also be a part of or a window in the general separating surface means.

The upper or first chamber which is preferably formed as a chamber for receiving a liquid is provided with at least one opening. The second chamber in which the illumination system is disposed is preferably also provided with an opening for inserting the components of the illumination system into the chamber. The lower or second chamber of the container can be covered by a sealing means which is preferably water-resistant and bears against the wall of the container so tightly that moisture cannot penetrate into the chamber. The lower or second chamber of the container may be sealed in widely different ways, for example by fitting a resilient cover thereonto or by pressing a cover into the opening into the container chamber.

The lighting set in the lower chamber preferably comprises a reflector, a lamp which is fitted into the reflector, a switch and a current source. The reflector is arranged below or behind the separating surface means, and the lamp is preferably arranged in the centre of the reflector surface. The back of the lamp preferably projects downwardly from the reflector, with the back of the lamp being in contact with the switch and with a current source. The current source is preferably a battery which is disposed in the container or outside the container, or an alternating current source which is disposed outside the container. The battery preferably has a voltage of from 1.5 to 22.5 V, in particular from 1.5 to 9 V. The alternating current source is preferably at a voltage of 110 to 380 V. The switch is also connected to the second terminal of the current source.

The reflector or mirror preferably comprises a plastics film or foil which is provided with a metal coating or which has a metal coating vapour-deposited thereon, or comprises metal. The surface of the reflector preferably has a high mirror finish and may be of various colours.

The switch preferably comprises two electrically conductive shell portions which are fitted together at their flat edge surfaces. An insulating ring is inserted between the edge surfaces, and at least one movable, electrically conductive contact making means is provided in the space formed by the curved configuration of the shell portions. Contact between the lamp and the current source is produced by a movable contact making means which is disposed in the switch and which is so arranged, when the container is in an inclined position, that the lamp is supplied with current. In the rest or vertical position of the container, the contact is not closed so that the lamp is not lit in that case. The movable contact making means preferably comprises at least one electrically conductive ball; the diameter of the ball must be at least such that the distance between the two electrically conductive shell portions of the switch is bridged across by the ball when the ball rolls into the edge region of the switch, when the switch is in an inclined position.

The lamp preferably comprises a mini incandescent lamp, a light emitting diode or a mini fluorescent tube.

The vessel configuration of the container according to the invention may be constructed in various ways, the material used preferably being glass and/or plexiglass. Any inherently stable transparent material can be used for the separating surface means between the two chambers. The transparent separating surface means may in particular also be in the form of a window within the general separating surface means, while the remainder of said general separating surface means may also be opaque or coloured. The transparent separating surface means may also be coloured.

The second chamber which contains the illumination system preferably has opaque side walls so that the content of that chamber is not visible from the outside.

The container according to the invention is in particular in the form of a drinking glass or a bottle or double bottle. The novel illumination system is also suitable for use for example in a double-chamber spice or seasoning container, for example a container for oil and vinegar.

In accordance with an embodiment of the invention, the container comprises two container chambers which are preferably arranged one above the other or one beside the other, with a transparent separating surface means or a transparent partial separating surface means being disposed between the two chambers of the container. In this case also, one chamber is designed to receive a fluid and is therefore provided with at least one opening. The second chamber which is separated from the first chamber contains the illumination system, while the second chamber is preferably provided with an opening for inserting the individual components of the illumination system into the second chamber. The switch between the lamp and the current source is in this case preferably a sensitive sensing means which is disposed on the outside surface of the container wall. The sensor comprises for example a pressure-sensitive and/or temperature-sensitive, inductive or capacitive sensor strip which is passed around the periphery of the container. The sensor used may also be in the form of individual sensor plates which are let into the outside periphery of the container, preferably in the lower region of the container. The sensor strips or plates are connected to the current source and to a lamp which is fitted into the reflector or mirror. At the moment at which the sensor on the outside periphery of the container is touched, the contact is closed and the lamp, which preferably comprises a mini incandescent lamp, light emitting diode or mini fluorescent tube, lights up. In the rest condition, or when the sensor is not touched, the circuit is broken and the lamp is not lit.

The lamp which is arranged in or on the reflector may be of such a configuration that the brightness thereof is altered in dependence on the inclination of the container or the switch. The brightness of the lamp preferably increases as the container is increasingly inclined, and decreases as the inclination of the container is reduced. The change in brightness of the lamp, with inclination of the container, may be achieved for example by the incorporation of an intermediate element or conventional resistor.

Figure 2:
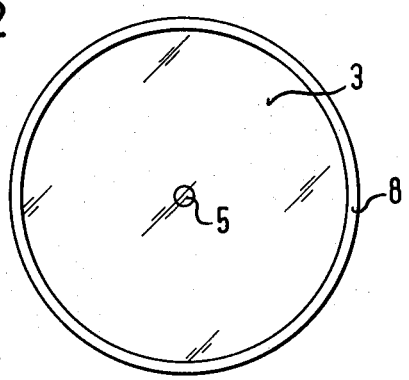
Figure 3:
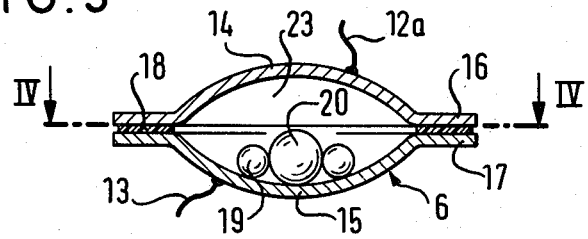
Figure 4:
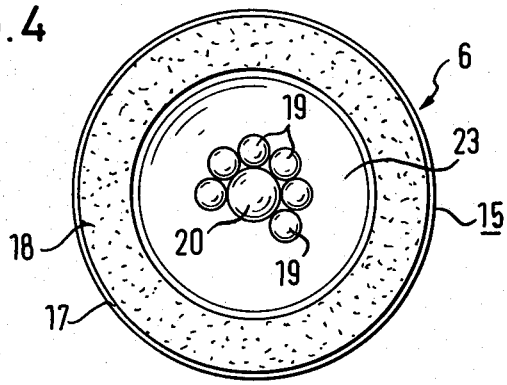
Figure 5:
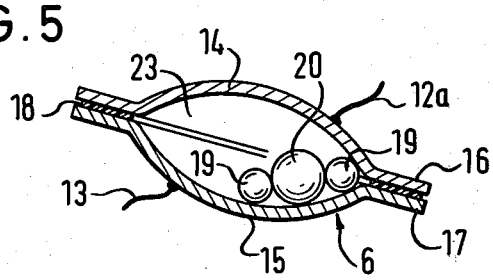
Figure 6:
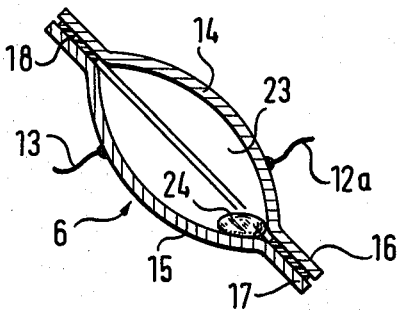
Figure 7:
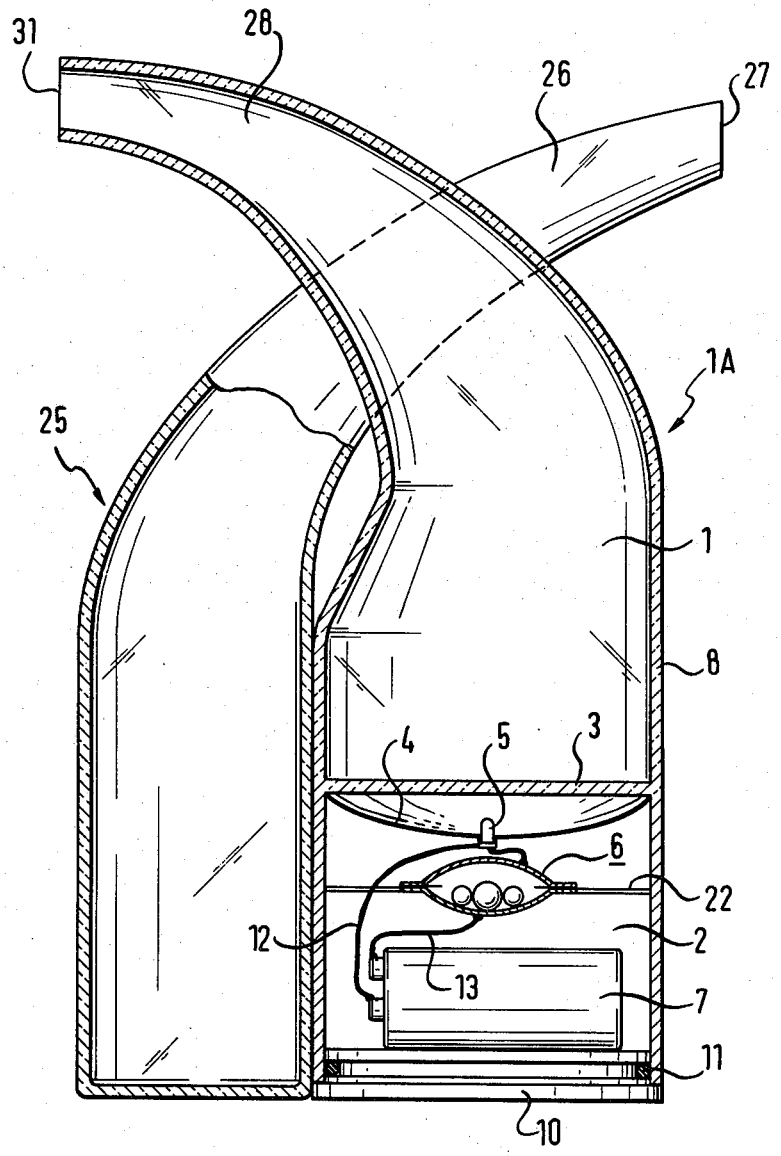
Figure 8:
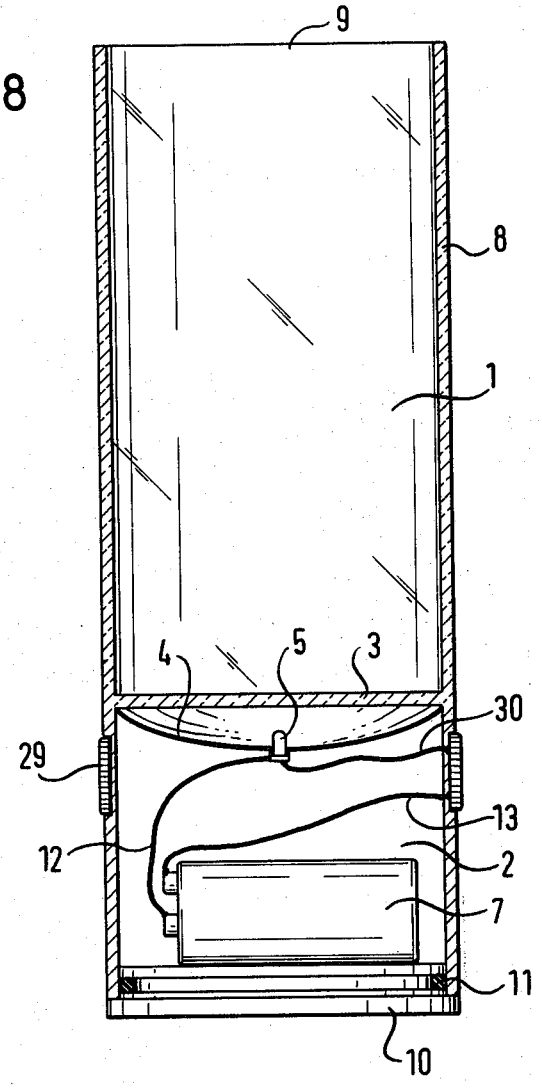
Figure 9:
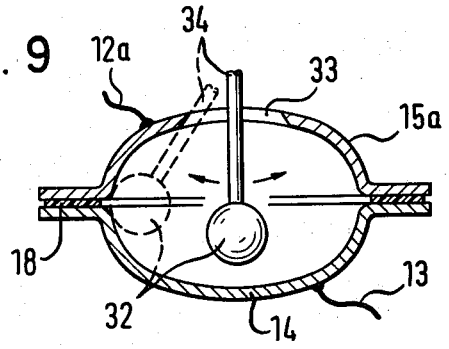

The container according to the invention is illustrated in greater detail by the accompanying drawings in which:

FIG. 1 shows a view in cross-section through a drinking glass according to the invention, FIG. 2 shows a plan view of the drinking glass of FIG. 1, FIG. 3 shows a view in cross-section through the switch of the container shown in FIG. 1, FIG. 4 shows a view of the switch shown in FIG. 3 in cross-section taken along line IV—IV therein, FIG. 5 shows a section out of the container shown in FIG. 1, in the position of use, FIG. 6 shows an embodiment of the switch, FIG. 7 shows a view in cross-section of an embodiment of the container shown in FIG. 1, FIG. 8 shows a view in cross-section of an embodiment of the container shown in FIG. 1, and FIG. 9 shows a further embodiment of the switch.

The container comprises a first or upper container chamber 1 and a lower or second container chamber 2, the chambers being separated from each other by a separating surface means or dividing wall portion 3. The separating surface means may be integrally connected to the container wall 8. The upper chamber 1 is provided with an opening 9, on the side thereof remote from the separating surface means. The opening in the lower chamber 2 is sealed off by a cover 10. The cover 10 is provided with a peripheral groove in which a sealing ring 11 is fitted. However, the lower chamber 2 may also be sealed off by other conventional sealing means, for example by pressing a resilient disc or plate into the opening, or by fitting a cover of suitable configuration on to the opening by engagement over the edge thereof.

Arranged below the separating surface means 3 or separating wall portion is a reflector 4 which in the present case is preferably of a parabolic configuration. A lamp 5 is fitted through the reflector, at the centre thereof. The lamp 5 may also be screwed into the reflector or secured therein by adhesive, if this is desirable. The reflector surface of the reflector 4 faces towards the separating surface means 3.

The lamp 5 is connected to the current source by way of a contact strip or a wire 12. The current source in the present case comprises a battery 7. The lamp 5 is connected by way of the wire 12*a* to the switch which in turn is connected to the current source 7 by means of a contact strip or wire 13. The battery 7 is preferably disposed below the switch 6.

The switch 6 comprises two spherical shell portions which have flat edge surfaces, more particularly, an upper shell portion 13 and a lower shell portion 15. The two flat edge regions 16 and 17 respectively of the two shell portions are separated from each other by an insulating ring 18 which is disposed therebetween. At least one movable contact making means is contained within the space 23 formed by the shell portions 14 and 15. In the switch shown in FIGS. 1 and 3, the movable contact making means comprises a ball of conductive material, in particular metal. The shell portions 14 and 15 of the switch 6 also comprise a conductive material, in particular metal. Copper, silver, nickel or alloys thereof are preferably used to form the contact making means and the shell portions.

It is preferable for a plurality of conductive balls to be disposed within the switch, as this arrangement ensures that contact is reliably made when the container according to the invention is tipped or moved into an inclined position.

FIG. 4 shows a view of the switch of FIG. 3 in section along line IV—IV, wherein the contact making means comprises six conductive balls 19 of smaller cross-section and a ball 20 of larger cross-section.

FIG. 5 shows the switch in the operative position, that is to say, in the position in which the switch is disposed when the container is in an inclined position. In this case, the electrically conductive balls roll into the edge region of the switch and then make the contact between the upper shell portion 14 and the lower conductive shell portion 15 so that the lamp 5 is connected to the battery 7. However, it is not absolutely necessary for the shell portions 14 and 15 to be of a spherical configuration, and they may also be flat or curved. Instead of the electrically conductive balls, it is also possible for the contact making means to be in the form of another movable contact making member, for example a drop of mercury as indicated at 24.

The reflector 4, the lamp 5, the switch 6 and the battery 7 are preferably replaceably arranged in the lower chamber 2. The reflector 4 and the switch 6 are preferably mounted in the lower chamber 2 by way of a support wall portion 21, but the reflector 4 may also be fixedly connected to the separating surface means 3. The switch 6 is preferably mounted by a support wall portion 22.

The outside wall and/or the inside wall of the lower chamber 2 is preferably opaque so that the illumination system is not visible from the exterior. It is also possible for a vision screen means to be disposed in the interior of the lower chamber, the screen means preferably acting at the same time as a support wall portion for the reflector 4 and the switch 6.

FIG. 6 shows an embodiment of the switch of the container according to the invention. The switch comprises the electrically conductive half shell portions 14 and 15 which are separated from each other by the insulating ring 18. The insulating ring is arranged between the edges of the shell portions 14 and 15, which are of a flat configuration. The contact making means in the space 23 formed by the two shell portions comprises in this embodiment an electrically conductive drop 24 of liquid, for example mercury.

FIG. 7 shows an embodiment of the container according to the invention of FIG. 1. This container comprises a first container 1A which comprises a chamber 1 and a second chamber 2. A second bottle-shaped container 25 is attached to the first container 1A, laterally thereof. The second container 25 is extended upwardly to form a neck 26, which has an opening 27 at its end. The bottle neck-like end 26 of the container 25 is preferably bent laterally over the main body part of the bottle-like container. The first bottle-like container 1A comprises an upper chamber 1 and a lower or second chamber 2, the two chambers being separated from each other by a separating surface means 3. The separating surface means 3 is transparent and is preferably integrally connected to the container wall 8 of the first container 1A. The upper chamber 1 is extended in a bottle neck-like configuration above the separating surface means 3, and is preferably bent over laterally. The neck 28 of the upper chamber 1 terminates at the opening 31. The necks 26 and 28 of the containers 25 and 1A respectively are preferably directed in opposite lateral directions. The opening of the lower chamber 2 of the container 1A is closed off by a cover 10. The cover 10 is provided with a peripheral groove in which a sealing ring 11 is fitted. However, the lower chamber 2 may also be closed off by other conventional closure means. Arranged below the separating surface means or dividing wall portion 3 is a reflector or mirror 4. A member which can be lit, for example an incandescent lamp 5, is passed through the reflector, at the centre thereof. The lighting member or incandescent lamp 5 is connected to the current source by way of a wire 12. In the present case, the current source comprises a battery 7. However, the current source may also comprise an alternating current source which is disposed outside the container. The lighting member 5 is also in contact with the switch 6 which in turn is connected to the current source 7 by means of a contact strip or a wire as indicated at 13.

The switch 6 for the container shown in FIG. 7 is the same switch as that shown in FIG. 1.

The container shown in FIG. 7 is suitable for example as a spice or seasoning container, with for example oil in one chamber and for example vinegar in the other chamber. When liquid is poured out or when the container is tilted, contact is made in the switch 6 and the lamp 5 is supplied with power and then lights up. The container shown in FIG. 7 may also with advantage be connected to an alternating current source if the container is preferably used standing on a table.

FIG. 8 shows an embodiment of the container of FIG. 1. This container comprises a first container chamber 1 and a second or lower container chamber 2, the two chambers being separated from each other by a separating surface means or dividing wall portion 3, or being connected to each other by the separating surface means. The separating surface means 3 is transparent or translucent and is integrally connected to the container wall 8. The upper chamber 1 is provided with an opening 9, on the side remote from the separating surface means 3.

The opening in the lower chamber 2 is closed off by a cover 10 which is provided with a peripheral groove in which a sealing ring 11 is fitted.

A reflector or mirror 4 is arranged below the separating surface means or dividing wall portion 3. A lamp 5 is fitted through the reflector at the centre of the reflector. The lamp 5 is connected by way of a wire 12 to a current source 7. In the present case, the current source comprises a battery 7. The lamp 5 is also in contact with the sensor 29 which is in the form of a strip let into the wall 8 of the lower chamber 2. The sensor 29 is connected to the current source 7 by way of the wire 13. The electrically conductive wire 13 may be passed through the container wall 8. However, the wire 13 may also be taken to the exterior through the opening of the lower chamber 2, and then connected to the sensor 29. Likewise, the connecting wire 30 between the lamp 5 and the sensor 29 may either be passed through the container wall 8 or may be taken through the bottom opening of the chamber 2.

If the sensor 29 which may be in the form of a small plate is touched, the circuit between the current source and the lamp 5 is closed and the lamp 5 is lit. In the rest condition, that is to say, when the sensor is not touched, the circuit between the lamp 5 and the current source 7 is interrupted. The lamp 5 may be in the form of a mini incandescent lamp, a light emitting diode or a mini fluorescent tube.

The sensor switch 29 preferably comprises a conventional pressure-sensitive sensor, a temperature-sensitive sensor, an inductively switched sensor or a capacitively switched sensor.

FIG. 9 shows a further embodiment of the switch 6. The switch comprises the electrically conductive lower shell portion 14 which is connected to the current source by way of the electrically conductive wire 13, and the upper shell portion **15*a*. An insulating ring 18 is inserted between the two edge regions of the upper and lower shell portions. The upper shell portion 15*a* is provided with an opening 33 through which the pendulum 34 is arranged to hang into the switch. The pendulum 34 has an electrically conductive clapper or knocker member 32 at its lower end. When the switch is in an inclined position, the pendulum 31 swings into the edge region of the switch and then bridges across the two electrically conductive shell portions 14 and 15*a*. The position of the pendulum when the switch is inclined is shown in broken lines in FIG. 9. The upper shell portion 5*a* is in contact with the lamp 5 by way of an electrically conductive wire 12*a*. The suspension for the knocker or clapper member 32** is preferably formed from an electrically conductive bar member which can possibly be surrounded by insulation.

I claim:

1. A container for a liquid comprising:

first and second chambers having a divider means therebetween for separating the chambers, a light means in the second chamber, the light means including a reflector, a light bulb passing through the reflector, a power source electrically connected to the light bulb, and a switch means electrically connected between the light bulb and power source, wherein the switch means comprises two electrically conductive shell portions with a space therebetween and insulating means separating the shell portions; and at least one movable, electrically-conductive contact means in the space.

2. A container according to claim 1, wherein the chambers are arranged one above or beside the other.

3. A container according to claim 1 or 2, wherein the chambers have at least one opening for introducing an article or a fluid.

4. A container according to claim 3, wherein at least the opening of the second chamber can be water-tightly closed.

5. A container according to claim 4, wherein the opening in the second chamber is adapted to be closed off by a cover which can be pressed into the opening or pressed onto the opening.

6. A container according to claim 1 or 2, wherein the form of the reflector is adapted to the inside diameter of the second chamber, the reflector surface is towards the divider means, and the lamp is preferably arranged at the center of the reflector.

7. A container according to claim 6, wherein the reflector is a hollow reflector, in particular a parabolic reflector.

8. A container according to claim 1, wherein the switch means is arranged below the lamp in the second chamber.

9. A container according to claim 1, wherein characterised the contact making means comprises at least one electrically conductive ball whose diameter is sufficient to bridge the distance between the shell portions, said distance being formed by the insulation means.

10. A container according to claim 9, wherein a plurality of electrically conductive balls with possibly different diameters are contained in the space formed by the shell portions.

11. A container according to claim 1, wherein the lamp and the switch means are connected to a battery which is disposed in the second chamber, or an alternating current source which is disposed outside the container.

12. A container according to claim 1 the lamp is a mini incandescent lamp, a light emitting diode or a mini fluorescent tube.

13. A container according to claim 1, wherein the first chamber, the second chamber and/or the divider means comprise glass and/or plexiglass.

14. A container according to claim 13, wherein the first chamber, the second chamber and the divider means are integrally connected together.

15. A container according to claim 13, wherein the side wall of the second chamber is opaque.

16. A container according to claim 1, wherein the first and second chambers are arranged one beside the other and at least a part of the divider means between the two container chambers is formed from a transparent separating surface means.

17. A container according to claim 16, wherein only one of the chambers which are arranged one beside the other, has the light means disposed therein.

18. A container according to claim 17, wherein the transparent separating surface means or divider means is arranged either between the two chambers which are arranged perpendicularly one beside the other, or within a container, having the divider means between an upper and a lower chamber.

19. A container according to claim 1, wherein the switch is a sensor, in particular a pressure-sensitive, temperature-sensitive, inductive or capacitive sensor, which is provided on the outside surface of the container.

* * * * *